US011342676B2

(12) United States Patent
Shailendra et al.

(10) Patent No.: US 11,342,676 B2
(45) Date of Patent: May 24, 2022

(54) ANTENNA

(71) Applicant: FUJIKURA LTD., Tokyo (JP)

(72) Inventors: Kaushal Shailendra, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 129 days.

(21) Appl. No.: 17/040,590

(22) PCT Filed: Mar. 25, 2019

(86) PCT No.: PCT/JP2019/012557
§ 371 (c)(1),
(2) Date: Sep. 23, 2020

(87) PCT Pub. No.: WO2019/189008
PCT Pub. Date: Oct. 3, 2019

(65) Prior Publication Data

US 2021/0075113 A1 Mar. 11, 2021

(30) Foreign Application Priority Data

Mar. 30, 2018 (JP) ..... JP2018-066400

(51) Int. Cl.
*H01Q 9/04* (2006.01)
*H01Q 21/08* (2006.01)
(Continued)

(52) U.S. Cl.
CPC ..... *H01Q 9/0457* (2013.01); *H01Q 1/48* (2013.01); *H01Q 21/0006* (2013.01); *H01Q 21/08* (2013.01)

(58) Field of Classification Search
CPC ..... H01Q 9/04; H01Q 9/0407; H01Q 9/045; H01Q 9/0457; H01Q 21/0006;
(Continued)

(56) References Cited

U.S. PATENT DOCUMENTS 9,985,346 B2 * 5/2018 Baks ..... H01L 23/66
10,594,019 B2 * 3/2020 Baks ..... H01Q 9/0407
(Continued)

FOREIGN PATENT DOCUMENTS

EP 2840649 A1 2/2015
JP 2002-163762 A 6/2002
(Continued)

OTHER PUBLICATIONS

International Search Report dated Jun. 4, 2019, issued in counterpart International Application No. PCT/JP2019/012557 (5 pages, including Japanese original and English translation).

*Primary Examiner* — Jason Crawford
(74) *Attorney, Agent, or Firm* — WHDA, LLP

(57) ABSTRACT

To improve a gain of an antenna. An antenna 1 includes a dielectric layer 6, a conductive ground layer 7 bonded to the layer 6 and including active slots 7*c*-7*f* aligned at regular intervals, aligned active elements 9*c*-9*f* formed facing the active slots 7*c*-7*f*, respectively, first passive elements 9*b*, 9*a* aligned with and extending from one end of a row of the active elements 9*c*-9*f*, second passive elements 9*g*, 9*h* aligned with and extending from the other end of the row, a feed line 4*a* formed on a side opposite to the layer 7 with respect to the layer 6, to be electromagnetically coupled to the active elements 9*c*-9*f* via the active slots 7*c*-7*f*. The second passive elements 9*g*, 9*h* are arranged in line symmetry with the first passive elements 9*b*, 9*a* with respect to a line 9*z* passing through the center of the row and perpendicular to the row.

6 Claims, 20 Drawing Sheets

(51) Int. Cl.
*H01Q 1/48* (2006.01)
*H01Q 21/00* (2006.01)

(58) Field of Classification Search
CPC ..... H01Q 21/06; H01Q 21/061; H01Q 5/378; H01Q 5/385; H01Q 13/10; H01Q 13/18
See application file for complete search history.

(56) References Cited

U.S. PATENT DOCUMENTS

| | | | | |
|---|---|---|---|---|
| 2004/0041732 | A1* | 3/2004 | Aikawa | H01Q 9/0457 343/700 MS |
| 2010/0001906 | A1 | 1/2010 | Akkermans et al. | |
| 2010/0190464 | A1 | 7/2010 | Chen et al. | |
| 2012/0212384 | A1 | 8/2012 | Kam et al. | |
| 2015/0054700 | A1 | 2/2015 | Belmkaddem et al. | |
| 2015/0129668 | A1 | 5/2015 | Kam et al. | |
| 2018/0331432 | A1 | 11/2018 | Kawaguchi et al. | |
| 2019/0363432 | A1* | 11/2019 | Hayashi | H01Q 1/38 |
| 2020/0335860 | A1* | 10/2020 | Hasegawa | H01Q 21/065 |
| 2021/0075112 | A1* | 3/2021 | Shailendra | H01Q 1/38 |
| 2021/0075113 | A1* | 3/2021 | Shailendra | H01Q 21/08 |

FOREIGN PATENT DOCUMENTS

| | | | |
|---|---|---|---|
| JP | 2004-320431 | A | 11/2004 |
| JP | 2010-16789 | A | 1/2010 |
| JP | 2017-46107 | A | 3/2017 |

* cited by examiner

ANTENNA

TECHNICAL FIELD

The present disclosure relates to an antenna.

BACKGROUND ART

Patent Literature 1 discloses an array antenna of a direct feeding system and a coplanar feeding system. The direct feeding system refers to a feeding system in which a feed line is directly connected to an antenna element. The coplanar feeding system refers to a feeding system in which a feed line and an antenna element are formed on a common plane.

As described in Patent Literature 1, a conductive ground layer is formed on one surface of a dielectric substrate, and a plurality of antenna elements and a plurality of feed lines are formed on the other surface of the dielectric substrate. The plurality of antenna elements are linearly aligned. The feed line extends from each of the antenna elements. Terminals of the feed lines extending from end antenna elements located at both ends of a row of the antenna elements are open, and the end antenna elements are passive elements. Terminals of the feed lines extending from middle antenna elements other than the end antenna elements are connected to a transmitter and receiver circuit, and the middle antenna elements are active elements. The passive elements at the both ends are provided to reduce a difference in directivity of the active elements.

CITATION LIST

Patent Literature

Patent Literature 1: Japanese Patent Application Publication No. 2017-46107

SUMMARY OF INVENTION

Technical Problem

Incidentally, it is desired to improve a gain of an antenna.

Accordingly, the present disclosure has been achieved in view of the circumstances described above. An object of the present disclosure is to improve a gain of an antenna.

Solution to Problem

A primary aspect of the present disclosure to achieve an object described above is an antenna comprising: a dielectric layer; a conductive ground layer bonded to the dielectric layer, the conductive ground layer including even-numbered active slots aligned at regular intervals; a plurality of active elements formed so as to face the active slots, respectively, the active elements aligned at regular intervals; one or more first passive elements aligned with and extending from one end of a row of the active elements; one or more second passive elements aligned with and extending from another end of the row of the active elements; and a feed line formed on a side opposite to the conductive ground layer with respect to the dielectric layer, the feed line configured to be electromagnetically coupled to the active elements via the active slots, the one or more second passive elements being arranged in line symmetry with the one or more first passive elements with respect to a line that passes through the center of the row of the active elements and is perpendicular to the row.

Other features of the present disclosure will become apparent from the following description and the drawings.

Advantageous Effects of Invention

According to an embodiment of the present disclosure, it is possible to improve a gain of an antenna.

DESCRIPTION OF EMBODIMENTS

Figure 1:
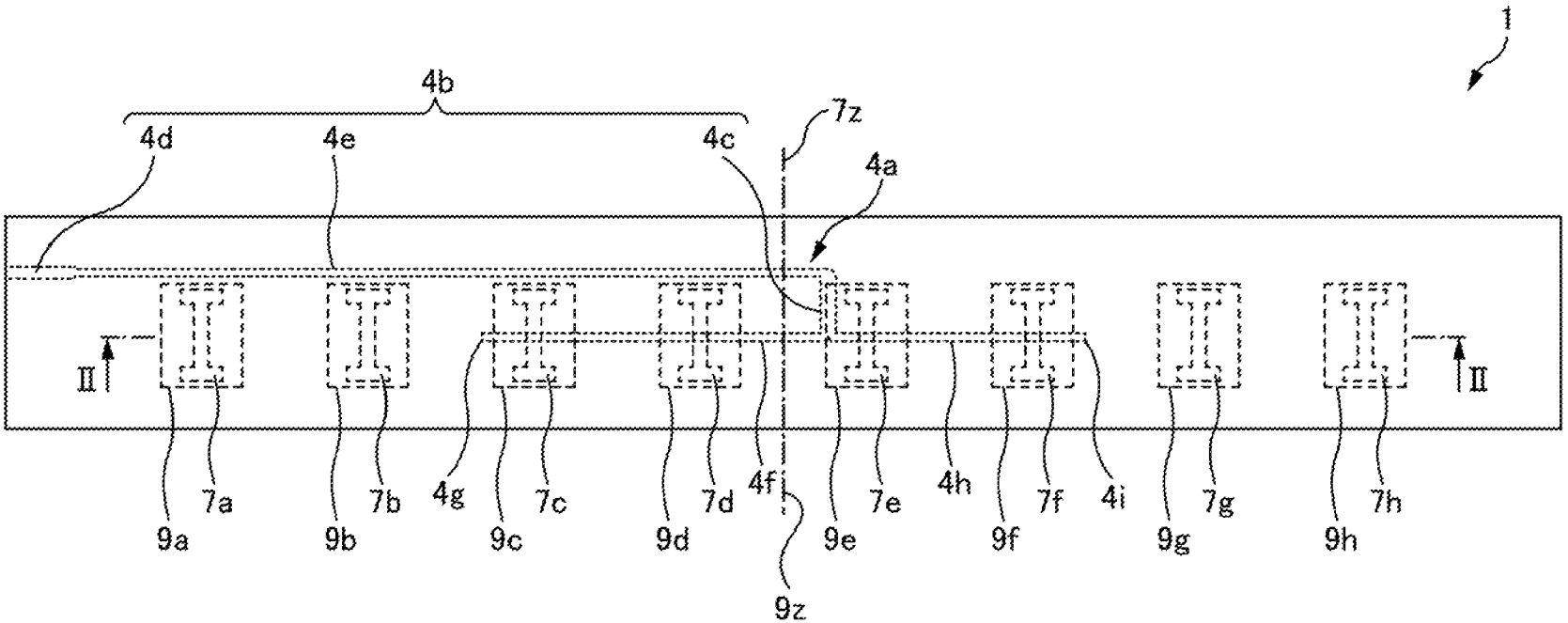
FIG. 1 is a plan view of an antenna according to an embodiment of the present disclosure.

At least the following matters will become apparent from the following description and the drawings.

An antenna will become apparent which comprises a dielectric layer; a conductive ground layer bonded to the dielectric layer, the conductive ground layer including even-numbered active slots aligned at regular intervals; a plurality of active elements formed so as to face the active slots, respectively, the active elements aligned at regular intervals; one or more first passive elements aligned with and extending from one end of a row of the active elements; one or more second passive elements aligned with and extending from another end of the row of the active elements; and a feed line formed on a side opposite to the conductive ground layer with respect to the dielectric layer, the feed line configured to be electromagnetically coupled to the active elements via the active slots, the one or more second passive elements being arranged in line symmetry with the one or more first passive elements with respect to a line that passes through the center of the row of the active elements and is perpendicular to the row.

As described above, the first passive elements are aligned with and extending from one end of the row of the active elements, and the second passive elements are aligned with and extending from the other end of the row of the active elements, thereby improving a gain of the antenna. Since the conductive ground layer is located between the feed line, and the active elements, the first passive elements, and the second passive elements, radiation of an electromagnetic wave in the feed line is less likely to affect radiation in the active elements, the first passive elements, and the second passive elements.

The conductive ground layer includes one or more first passive slots formed so as to face at least one of the first passive elements, and one or more second passive slots formed so as to face at least one of the second passive elements.

This improves a gain of an antenna.

The conductive ground layer includes the one or more first passive slots formed so as to face all of the one or more first passive elements, and the one or more second passive slots formed so as to face all of the one or more second passive elements.

This further improves a gain of an antenna.

The feed line branches at a point between the active slots adjacent to each other that are positioned in the center of the row of the active slots in plan view, the feed line having branch portions that extend from the point of branch until the branch portions cross the active slots at both ends of the row of the active slots in plan view, respectively.

A difference between an electrical length of a portion from the point of branch to one of the active slots adjacent to each other in plan view in the feed line and an electrical length of a portion from the point of branch to another of the active slots adjacent to each other in plan view in the feed line is equal to a quarter of an effective wavelength in the center of a band to be used.

This improves a gain of an antenna.

The antenna further comprises a dielectric substrate including a recess, wherein the conductive ground layer is bonded to the dielectric substrate so as to cover the recess, the active slots are arranged on an inner side with respect to the recess, and the active elements, the first passive elements, and the second passive elements are formed on a bottom of the recess.

Accordingly, the recess results in becoming a hollow, and the hollow is interposed between the active elements and the active slots. This can reduce a dielectric loss when a signal wave is transmitted between the feed line and the active elements via the slots. Thus, a gain of the antenna is improved.

Embodiments

Embodiments of the present disclosure will be described below with reference to the drawings. Note that various limitations that are technically preferable for carrying out the present disclosure are imposed on embodiments which will be described below, however, the scope of the disclosure is not to be limited to the following embodiments or illustrated examples.

Figure 2:
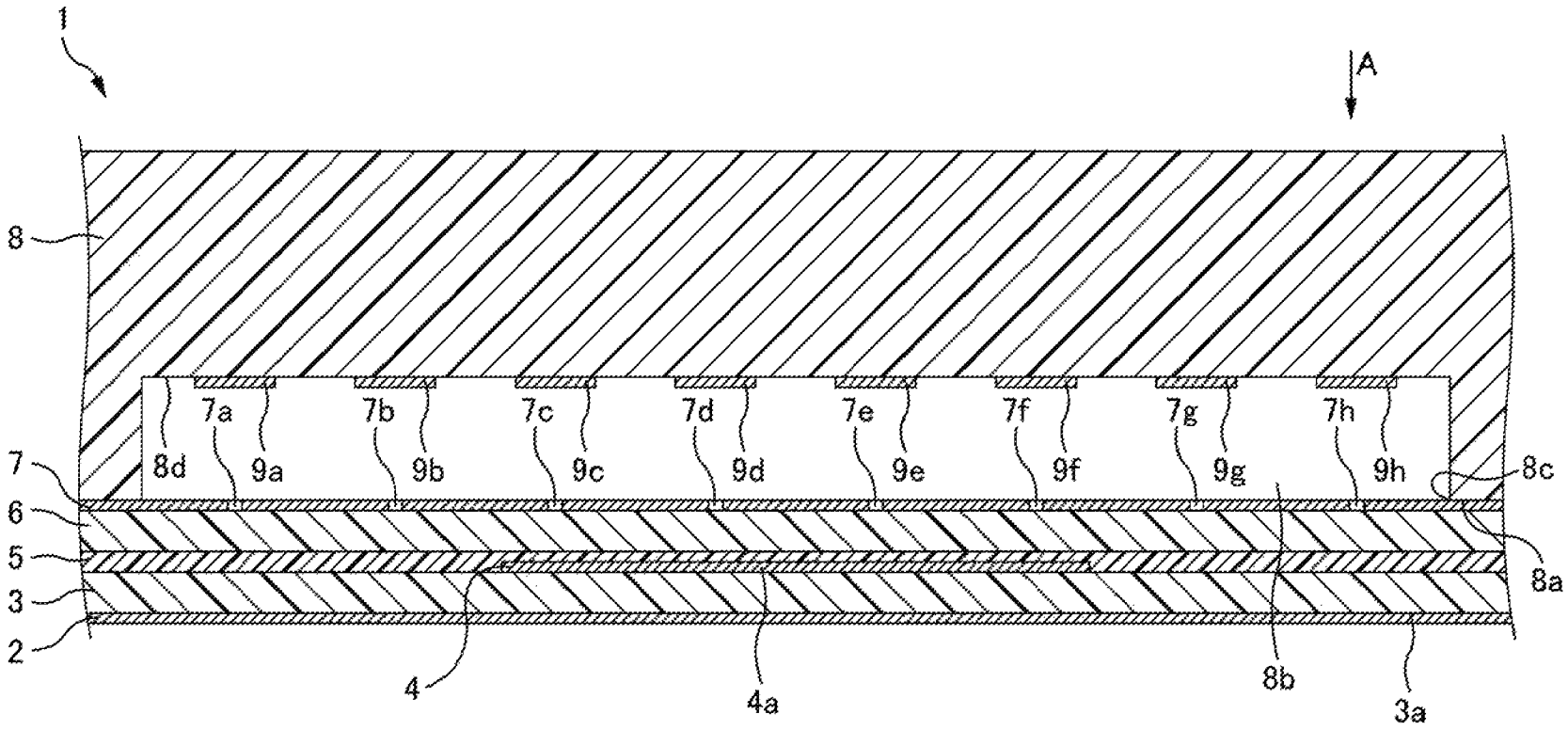
FIG. 2 is a cross-sectional view thereof taken along line II-II of FIG. 1.

FIG. 1 is a schematic plan view of an antenna 1. FIG. 2 is a cross-sectional view thereof taken along line II-II of FIG. 1.

The antenna 1 is used for transmitting, receiving, or both transmitting and receiving a radio wave in a frequency band of a microwave or a millimeter wave.

A dielectric layer 3 and a dielectric layer 6 are bonded to each other, using a dielectric adhesive layer 5, with a conductive pattern layer 4 sandwiched therebetween. The dielectric layer 3 and the dielectric layer 6 are made of a liquid crystal polymer.

The conductive pattern layer 4 is formed between the dielectric layer 3 and the adhesive layer 5. Note that the conductive pattern layer 4 may be formed between the dielectric layer 6 and the adhesive layer 5.

A conductive ground layer 2 is formed on a surface 3*a* of the dielectric layer 3 on a side opposite to the conductive pattern layer 4 with respect to the dielectric layer 3.

The dielectric layer 6 and a dielectric substrate 8 are bonded to each other with a conductive ground layer 7 sandwiched therebetween. The dielectric layer 6 is bonded to the conductive ground layer 7 on a side opposite to the dielectric substrate 8 with respect to the conductive ground layer 7.

The conductive ground layer 7 is formed between the dielectric layer 6 and the dielectric substrate 8.

As described above, the conductive ground layer 2, the dielectric layer 3, the conductive pattern layer 4, the adhesive layer 5, the dielectric layer 6, the conductive ground layer 7, and the dielectric substrate 8 are laminated in this order. A laminated body from the conductive ground layer 2 to the conductive ground layer 7 is flexible, and the dielectric substrate 8 is rigid. Bending deformation of the antenna 1 is less likely to occur by virtue of the dielectric substrate 8 bonded to the laminated body that is from the conductive ground layer 2 to the conductive ground layer 7.

The thickness of the dielectric substrate 8 is greater than the thickness of each of the dielectric layers 3 and 6 and the adhesive layer 5, and is also greater than the total thickness of the dielectric layers 3 and 6 and the adhesive layer 5.

The conductive ground layer 2, the conductive pattern layer 4, and the conductive ground layer 7 are made of a conductive metal material such as copper.

The conductive ground layer 7 is processed and shaped by an additive method, a subtractive method, or the like, and thus a plurality of I-shaped slots 7*a* to 7*h* are formed in the conductive ground layer 7. Note that the shape of the slots 7*a* to 7*h* is not limited to the I shape, and may be a rectangular shape, a round shape, or other shapes.

Hereinafter, the slots 7*a* and 7*b* are referred to as first passive slots 7*a* and 7*b*, the slots 7*c* to 7*f* are referred to as active slots 7*c* to 7*f*, and the slots 7*g* and 7*h* are referred to as second passive slots 7*g* and 7*h*.

The active slots 7*c* to 7*f* are aligned at regular intervals in a short-side direction of the active slots 7*c* to 7*f*. The first passive slots 7*b* and 7*a* are aligned with and extending from one end of a row of the active slots 7*c* to 7*f*, and the second passive slots 7*g* and 7*h* are aligned with and extending from the other end of the row of the active slots 7*c* to 7*f* Accordingly, the slots 7*a* to 7*h* are linearly aligned at regular intervals. A specific alignment order is the order of the slot 7*a*, the slot 7*b*, the slot 7*c*, the slot 7*d*, the slot 7*e*, the slot 7*f*, the slot 7*g*, and the slot 7*h* from the left in FIG. 1.

Since the slots 7*a* to 7*h* are aligned at regular intervals, the first passive slot 7*a* and the second passive slot 7*h* are arranged in line symmetry with respect to a line 7*z* that passes through the center of the row of the active slots 7*c* to 7*f* and is perpendicular to the row. Similarly, the first passive slot 7*b* and the second passive slot 7*g* are arranged in line symmetry with respect to the line 7*z*.

The conductive pattern layer 4 is processed and shaped by an additive method, a subtractive method, or the like, and thus the conductive pattern layer 4 includes a feed line 4*a*. The feed line 4*a* is formed on a side opposite to the conductive ground layer 7 with respect to the dielectric layer 6, and is formed on the dielectric layer 3 on a side opposite to the conductive ground layer 2 with respect to the dielectric layer 3. Since the feed line 4*a* is located between the conductive ground layer 2 and the conductive ground layer 7, the feed line 4*a* constitutes a triplate or strip-line transmission line together with the conductive ground layer 2 and the conductive ground layer 7.

The feed line 4*a* is a line branching in a T-shape. The feed line 4*a* includes a main line portion 4*b* and branch line portions 4*f* and 4*h*.

The main line portion 4*b* is formed in an L shape.

The branch line portions 4*f* and 4*h* are formed by branching from one end portion 4*c* of the main line portion 4*b* at position between the active slots 7*d* and 7*e* adjacent to each other in the center of the row of the active slots 7*c* to 7*f*. The branch line portions 4*f* and 4*h* extend linearly in directions opposite to each other from a branch point. A direction in which the branch line portions 4*f* and 4*h* extend is parallel to a direction in which the active slots 7*c* to 7*f* are aligned.

The other end portion 4*d* of the main line portion 4*b* is connected to a terminal of a radio frequency integrated circuit (RFIC).

The width of the one end portion 4*c* and the other end portion 4*d* of the main line portion 4*b* is wider than the width of a portion 4*e* between the one end portion 4*c* and the other end portion 4*d*. Thus, the impedance of the one end portion 4*c* and the other end portion 4*d* of the main line portion 4*b* is smaller than the impedance of the portion 4*e* between the one end portion 4*c* and the other end portion 4*d*. For example, the impedance of the one end portion 4*c* and the other end portion 4*d* of the main line portion 4*b* is a half of the impedance of the portion 4*e* between the one end portion 4*c* and the other end portion 4*d*.

The width of the branch line portions 4*f* and 4*h* is smaller than the width of the one end portion 4*c* and the other end portion 4*d* of the main line portion 4*b*, and is equal to the width of the portion 4*e* between the one end portion 4*c* and the other end portion 4*d*. Thus, the impedance of the branch line portions 4*f* and 4*h* is greater than the impedance of the one end portion 4*c* and the other end portion 4*d* of the main line portion 4*b*. For example, the impedance of the branch line portions 4*f* and 4*h* is twice the impedance of the one end portion 4*c* and the other end portion 4*d* of the main line portion 4*b*.

The branch line portion 4*f* extends from the branch point until the branch line portion 4*f* crosses the active slots 7*d* and 7*c* in plan view, and the branch line portion 4*f* is open at one end 4*g* thereof. The impedance of a portion from the one end 4*g* to immediately below the active slot 7*c* in the branch line portion 4*f* is adjusted according to the length from the position facing the center of the active slot 7*c* to the one end 4*g* of the branch line portion 4*f*. Herein, the plan view refers to viewing the antenna 1 from above the antenna 1, in other words, viewing the antenna 1 in a direction of an arrow A illustrated in FIG. 2.

The branch line portion 4*h* extends from the branch point until the branch line portion 4*h* crosses the active slots 7*e* and 7*f* in plan view, and the branch line portion 4*h* is open at one end 4*i* thereof. The impedance of a portion from the one end 4*i* to immediately below the active slot 7*f* in the branch line portion 4*h* is adjusted according to the length from a position facing the center of the active slot 7*f* to the one end 4*i* of the branch line portion 4*h*.

The electrical length of the portion from the branch point of the feed line 4*a* to immediately below the active slot 7*d* is different from the electrical length of the portion from the branch point to immediately below the active slot 7*e*. Specifically, a difference between the electrical length of the portion from the branch point of the feed line 4*a* to immediately below the active slot 7*d* and the electrical length of the portion from the branch point to immediately below the active slot 7*e* is equal to a quarter of the effective wavelength in the center of a band to be used. This improves again of the antenna 1 (see Verification 4 described below). Note that a difference between the electrical length of the portion from the branch point to immediately below the active slot 7*d* and the electrical length of the portion from the branch point to immediately below the active slot 7*e* in the feed line 4*a* may be equal to a half of the effective wavelength in the center of a band to be used. The electrical length of the portion from the branch point to immediately below the active slot 7*d* in the feed line 4*a* may be equal to the electrical length of the portion from the branch point to immediately below the active slot 7*e*.

A recess 8*b* is formed in a bonding surface 8*a*, which is to be bonded to the conductive ground layer 7 out of two surfaces of the dielectric substrate 8. An opening 8*c* of the recess 8*b* faces the slots 7*a* to 7*h*, and the bonding surface 8*a* of the dielectric substrate 8 is bonded to the conductive ground layer 7. The opening 8*c* of the recess 8*b* is covered with the conductive ground layer 7, resulting in the recess 8*b* being a hollow. The slots 7*a* to 7*h* are arranged on the inner side with respect to the edge of the opening 8*c* of the recess 8*b*. A bottom 8*d* of the recess 8*b* faces the conductive ground layer 7. The bottom 8*d* of the recess 8*b* is flat, and is parallel to the conductive ground layer 7. The depth of the recess 8*b*, in other words, the height of the hollow is greater than the thickness of each of the dielectric layers 3 and 6 and the adhesive layer 5.

Patch-type first passive elements 9*a* and 9*b*, active elements 9*c* to 9*f*, and second passive elements 9*g* and 9*h* are formed on the bottom 8*d* of the recess 8*b*. The elements 9*a* to 9*h* are aligned at regular intervals in a direction parallel to the direction in which the slots 7*a* to 7*h* are aligned. Thus, the first passive element 9*a* and the second passive element 9*h* are arranged in line symmetry with respect to a line 9*z* that passes through the center of a row of the active elements 9*c* to 9*f* and is perpendicular to the row. Similarly, the first passive element 9*b* and the second passive element 9*g* are arranged in line symmetry with respect to the line 9*z*.

The first passive element 9*a* faces the first passive slot 7*a*. The first passive element 9*b* faces the first passive slot 7*b*. The active element 9*c* faces the active slot 7*c*. The active element 9*d* faces the active slot 7*d*. The active element 9*e* faces the active slot 7*e*. The active element 9*f* faces the active slot 7*f*. The second passive element 9*g* faces the second passive slot 7*g*. The second passive element 9*h* faces the second passive slot 7*h*. The active element 9*c* is configured to be electromagnetically coupled to the branch line portion 4*f* of the feed line 4*a* through the active slot 7*c*. The active element 9*d* is configured to be electromagnetically coupled to the branch line portion 4*f* of the feed line 4*a* through the active slot 7*d*. The active element 9*e* is configured to be electromagnetically coupled to the branch line portion 4*h* of the feed line 4*a* through the active slot 7*e*. The active element 9*f* is configured to be electromagnetically coupled to the branch line portion 4*h* of the feed line 4*a* through the active slot 7*f*. Accordingly, when the RFIC is a transmitter or a transceiver, signal waves transmitted from the RFIC using the feed line 4*a* are transmitted to the active elements 9*c* to 9*f* through the active slots 7*c* to 7*f*, respectively, and electromagnetic waves generated with the signal waves are radiated from the active elements 9*c* to 9*f*. When the RFIC is a receiver or a transceiver, signal waves generated with electromagnetic waves being incident on the active elements 9*c* to 9*f* are transmitted to the feed line 4*a* through the active slots 7*c* to 7*f*, respectively, and the signal waves are transmitted to the RFIC using the feed line 4*a*.

Herein, since the branch line portion 4*f* of the feed line 4*a* crosses the active slot 7*c* in plan view, impedance matching is achieved among the portion from the one end 4*g* to immediately below the active slot 7*c* in the branch line portion 4*f*, the active slot 7*c*, and the active element 9*c*. Since the branch line portion 4*h* of the feed line 4*a* crosses the active slot 7*f* in plan view, impedance matching is achieved among the portion from the one end 4*i* to immediately below the active slot 7*f* in the branch line portion 4*h*, the active slot 7*f*, and the active element 9*f*.

According to an embodiment according to the present disclosure as described above, the first passive elements 9*b* and 9*a* are aligned with and extending from one end of the row of the active elements 9*c* to 9*f*, and the second passive elements 9*g* and 9*h* are aligned with and extending from the other end of the row of the active elements 9*c* to 9*f*. The passive elements 9*a*, 9*b*, 9*g*, and 9*h* contribute to improvement in gain and widening of band of the antenna 1. This is verified by a simulation (see Verification 1 described below).

The rigid dielectric substrate 8 reduces bending of the laminated body that is from the conductive ground layer 2 to the conductive ground layer 7. Thus, reduction in thickness of the dielectric layers 3 and 6 and the adhesive layer 5 can be achieved. The reduction in thickness of the dielectric layers 3 and 6 and the adhesive layer 5 contributes to reduction in dielectric loss and improvement in radiation efficiency. Accordingly, a gain of the antenna 1 is high, and an applicable frequency band of the antenna 1 is wide.

A hollow formed with the recess 8*b* is present between the active elements 9*c* to 9*f* and the active slots 7*c* to 7*f*. A dielectric loss tangent in the hollow is substantially zero when the hollow is under an atmosphere of the air. Thus, a signal wave is not affected by a dielectric when the signal wave is transmitted between the active elements 9*c* to 9*f* and the active slots 7*c* to 7*f*, thereby being able to reduce occurrence of a dielectric loss. Accordingly, a gain of the antenna 1 is high, and an applicable frequency band of the antenna 1 is wide.

The passive elements 9*a*, 9*b*, 9*g*, and 9*h* face the passive slots 7*a*, 7*b*, 7*g*, and 7*h*, respectively. This contributes to improvement in gain and widening of the antenna 1. This is verified by a simulation (see Verification 2 described below).

Since the elements 9*a* to 9*h* are linearly aligned in a row, the antenna 1 has low directivity. In other words, the antenna 1 has not only high sensitivity in a normal direction, but also high sensitivity in a direction inclined to the row direction of the elements 9*a* to 9*h* with respect to the normal line. This is verified by a simulation (see Verification 3 described below).

Since the recess 8*b* is formed in the rigid dielectric substrate 8, the depth of the recess 8*b* (i.e., the height of the hollow) is less likely to change. Furthermore, a space between the elements 9*a* to 9*h* and the feed line 4*a* is also less likely to change. Thus, radiation characteristics of the antenna 1 is stabilized.

Since the conductive ground layer 7 is located between the elements 9*a* to 9*h* and the feed line 4*a*, radiation of an electromagnetic wave in the feed line 4*a* is less likely to affect radiation in the elements 9*a* to 9*h*.

<Verification 1>

Figure 3:
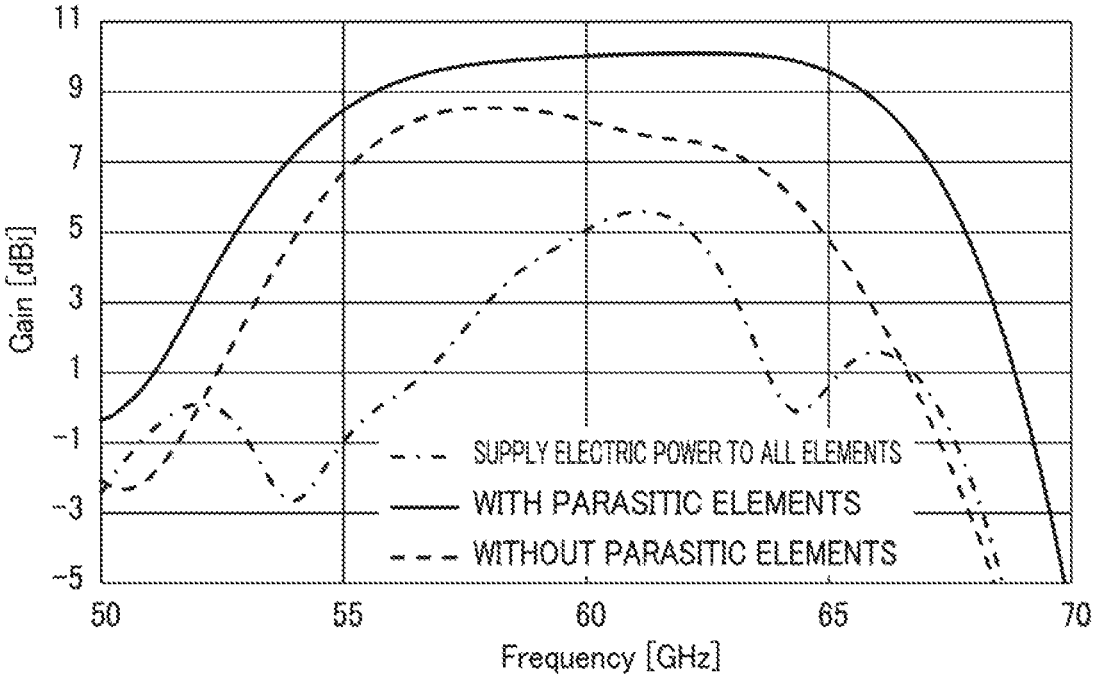
FIG. 3 is a graph illustrating a simulation result of a gain of an antenna according to the embodiment and a gain of an antenna according to a comparative example.

A contribution of the passive elements 9*a*, 9*b*, 9*g*, and 9*h* to improvement in radiation characteristics of the antenna 1 is verified by a simulation. A result of the simulation is illustrated in FIG. 3. The vertical axis represents a gain and the horizontal axis represents a frequency in a graph in FIG. 3. A solid line indicates a result using the antenna 1 as a simulation target. A broken line indicates a result using, as a simulation target, an antenna without the passive elements 9*a*, 9*b*, 9*g*, and 9*h* and the passive slots 7*a*, 7*b*, 7*g*, and 7*h*. A dashed-dotted line indicates a result using, as a simulation target, an antenna obtained by changing the passive elements 9*a*, 9*b*, 9*g*, and 9*h* into active elements such that the branch line portions 4*f* and 4*h* are extended from the one end portion 4*c* of the main line portion 4*b* until the branch line portions 4*f* and 4*h* cross the slots 7*a* and 7*h*, respectively, in plan view.

As apparent from FIG. 3, the antenna 1 including the passive elements 9*a*, 9*b*, 9*g*, and 9*h* and the passive slots 7*a*, 7*b*, 7*g*, and 7*h* has the highest gain. The antenna without the passive elements 9*a*, 9*b*, 9*g*, and 9*h* and the passive slots 7*a*, 7*b*, 7*g*, and 7*h* has a gain lower than that of the antenna 1 including the passive elements 9*a*, 9*b*, 9*g*, and 9*h* and the passive slots 7*a*, 7*b*, 7*g*, and 7*h*. The antenna obtained by changing the passive elements 9*a*, 9*b*, 9*g*, and 9*h* into the active elements has the lowest gain.

It is found from the foregoing simulation result that the passive elements 9*a*, 9*b*, 9*g*, and 9*h* contribute to improvement in radiation characteristics of the antenna 1.

<Verification 2>

Figure 4:
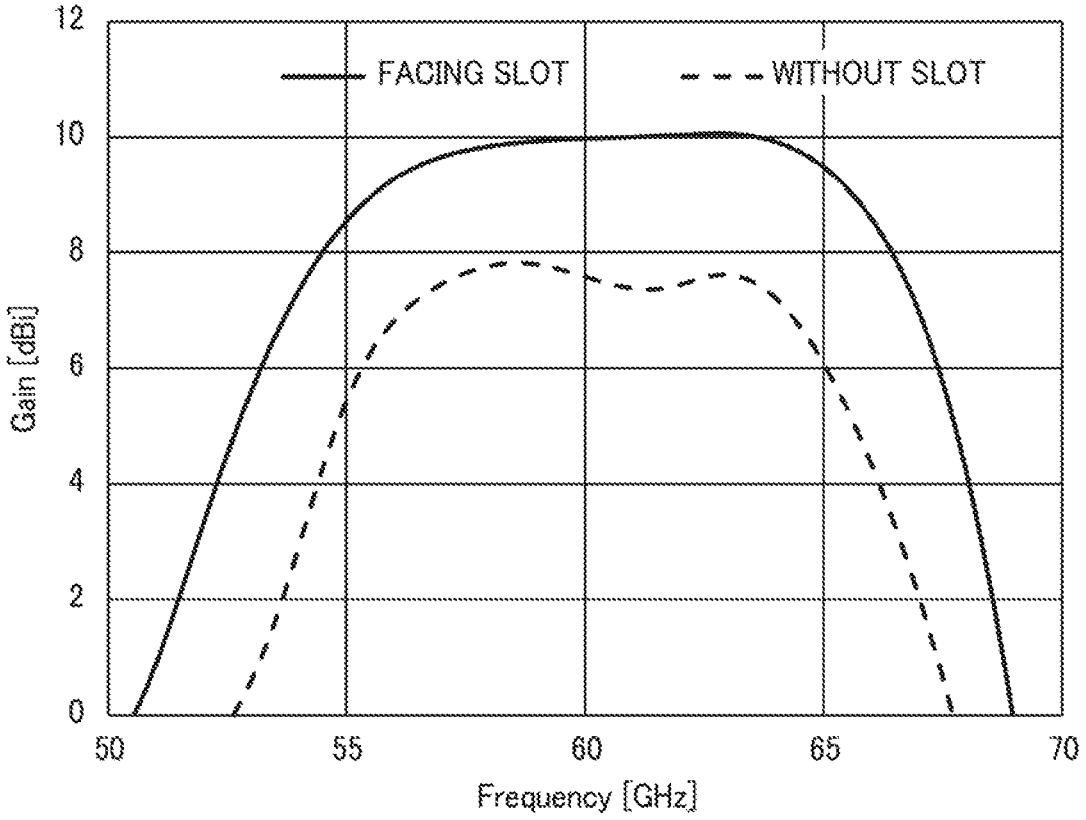
FIG. 4 is a graph illustrating a simulation result of a gain of an antenna with a passive slot and a gain of an antenna without a passive slot.

Improvement in radiation characteristics of the antenna 1 by virtue of the passive elements 9*a*, 9*b*, 9*g*, and 9*h* facing the passive slots 7*a*, 7*b*, 7*g*, and 7*h*, respectively, is verified by a simulation. A result of the simulation is illustrated in FIG. 4. The vertical axis represents a gain and the horizontal axis represents a frequency in a graph in FIG. 4. A solid line indicates a result using the antenna 1 as a simulation target. A broken line indicates a result using, as a simulation target, an antenna without the passive slots 7*a*, 7*b*, 7*g*, and 7*h*.

As apparent from FIG. 4, the antenna 1 provided with the passive slots 7*a*, 7*b*, 7*g*, and 7*h* has a gain higher than the antenna without the passive slots 7*a*, 7*b*, 7*g*, and 7*h*. Therefore, it is found that radiation characteristics of the antenna 1 are improved by virtue of the passive elements 9*a*, 9*b*, 9*g*, and 9*h* facing the passive slots 7*a*, 7*b*, 7*g*, and 7*h*, respectively.

<Verification 3>

Figure 5:
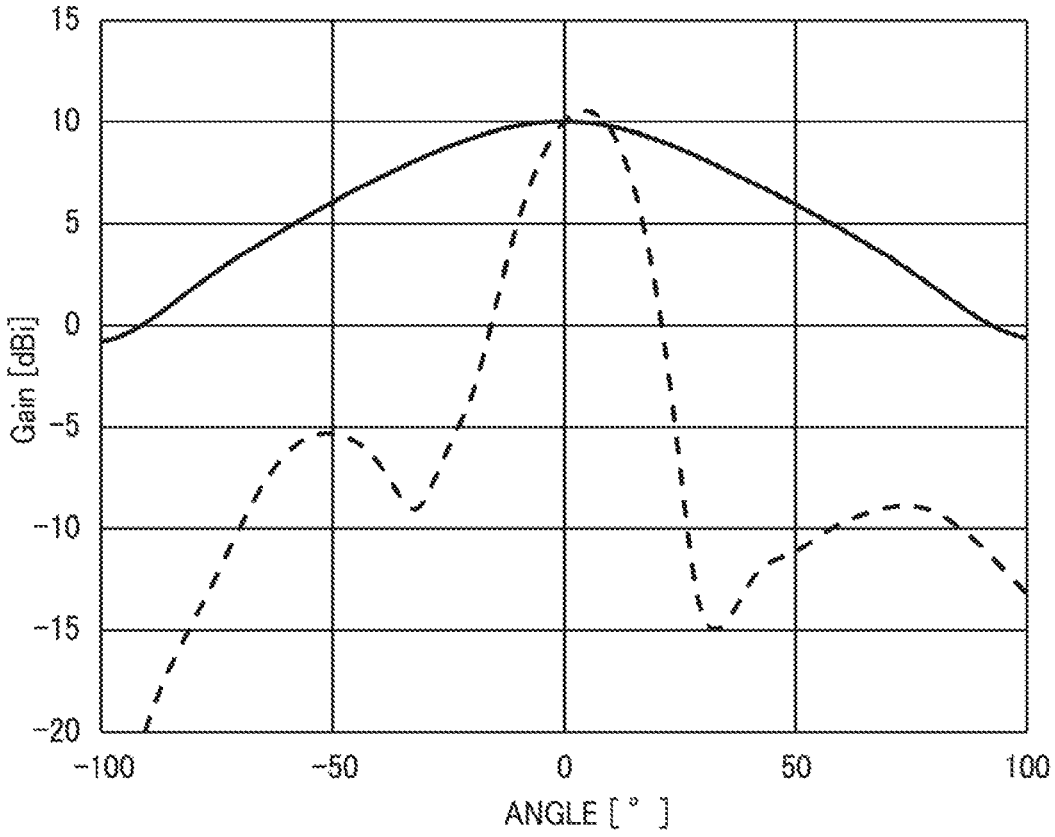
FIG. 5 is a graph illustrating a relationship between an inclination angle with respect to a normal line and a gain in a direction defined by the inclination angle.

A simulation has been performed to verify that sensitivity in the direction inclined to the row direction of the elements 9*a* to 9*h* from the normal line is high by virtue of the elements 9*a* to 9*h* being linearly aligned in a row. A result of the simulation is illustrated in FIG. 5. The vertical axis represents a gain at 60 GHz and the horizontal axis represents an inclination angle with respect to the normal line in a graph in FIG. 5. In a solid line, the inclination angle represented by the horizontal axis indicates an angle inclined to the row direction of the elements 9*a* to 9*h* from the normal line. In a broken line, the inclination angle represented by the horizontal axis indicates an angle inclined to a direction orthogonal to the row direction of the elements 9*a* to 9*h* from the normal line.

It is apparent from the solid line in FIG. 5 that a gain does not greatly lower even when the angle inclined to the row direction of the elements 9*a* to 9*h* increases.

<Verification 4>

Figure 6:
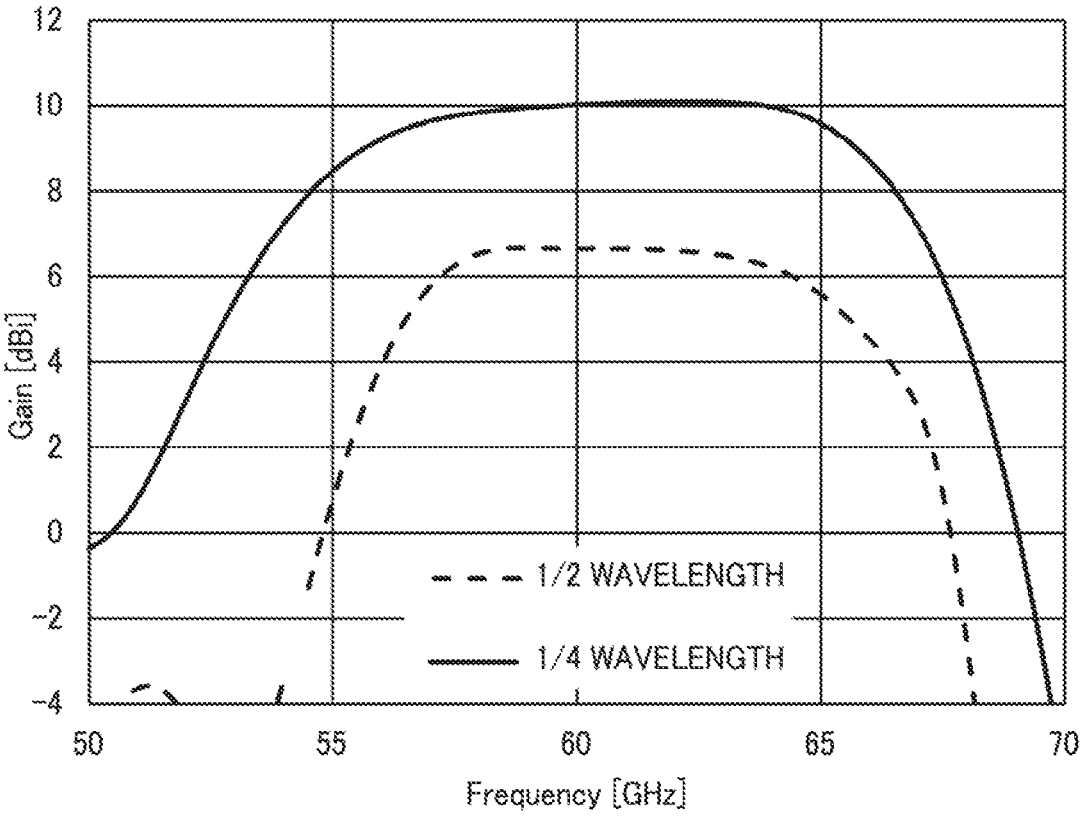
FIG. 6 is a graph illustrating a simulation result of a gain of an antenna with an electrical length difference between the two sides of feeding.

A gain of the antenna 1 has been simulated, and a result of the simulation is illustrated in FIG. 6. The vertical axis represents a gain and the horizontal axis represents a frequency in a graph in FIG. 6. A solid line is a simulation result when a difference between the electrical length of the portion from the branch point to immediately below the active slot 7*d* and the electrical length of the portion from the branch point to immediately below the active slot 7*e* in the feed line 4*a* is equal to a quarter of the effective wavelength in the center of a band to be used. A broken line is a simulation result when a difference between the electrical length of the portion from the branch point to immediately below the active slot 7*d* and the electrical length of the portion from the branch point to immediately below the active slot 7*e* in the feed line 4*a* is equal to a half of the effective wavelength in the center of a band to be used.

It is apparent from FIG. 6 that a gain of the antenna 1 is high when a difference between the electrical lengths is equal to a quarter of the effective wavelength in the center of the band to be used.

Modification Examples

Next, some modifications from an embodiment described above will be explained. The modifications which will be described below can be applied separately or in combination.

Figure 7:
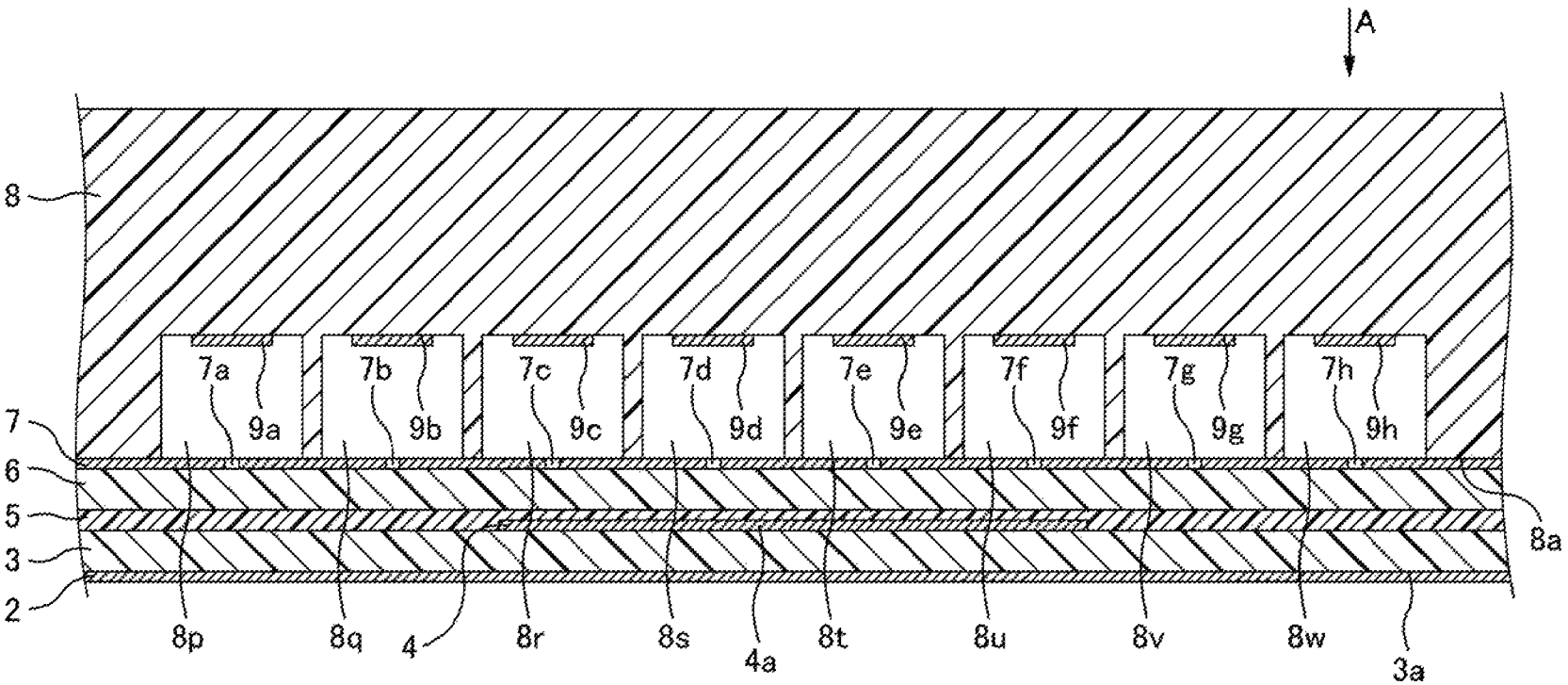
FIG. 7 is a cross-sectional view of an antenna according to another embodiment of the present disclosure.

(1) In an embodiment described above, the elements 9*a* to 9*h* are arranged in the single recess 8*b*. In contrast, as illustrated in FIG. 7, the same number of recesses 8*p* to 8*w* as the number of the elements 9*a* to 9*h* may be formed in the bonding surface 8*a* of the dielectric substrate 8, and the elements 9*a* to 9*h* may be individually disposed in the recesses 8*p* to 8*w*, respectively. In this case, the elements 9*a* to 9*h* are individually formed on the bottoms of the recesses 8*p* to 8*w*, respectively, the slots 7*a* to 7*h* are individually arranged on the inner side with respect to the openings of the recesses 8*p* to 8*w*, respectively, and the elements 9*a* to 9*h* face the slots 7*a* to 7*h*, respectively. This improves strength of the dielectric substrate 8 by virtue of portions each between adjacent two of the recesses 8*p* to 8*w*, so that the dielectric substrate 8 is less likely to be deformed. Thus, radiation characteristics of the antenna 1 are stabilized.

(2) In an embodiment described above, the recess 8*b* is formed in the bonding surface 8*a* of the dielectric substrate 8, and the elements 9*a* to 9*h* are arranged in the recess 8*b*. In contrast, a dielectric may be interposed between the elements 9*a* to 9*h* and the slots 7*a* to 7*h* without forming the recess 8*b*. In other words, the recess 8*b* may be filled with a dielectric.

(3) In an embodiment described above, the elements 9*a* to 9*h* are disposed on the bottom 8*d* of the recess 8*b*. In contrast, a configuration may be such that a dielectric layer is formed on the conductive ground layer 7, the elements 9*a* to 9*h* are formed on the dielectric layer, and further a different dielectric substrate is bonded to the dielectric layer to cover the elements 9*a* to 9*h*.

Figure 8:
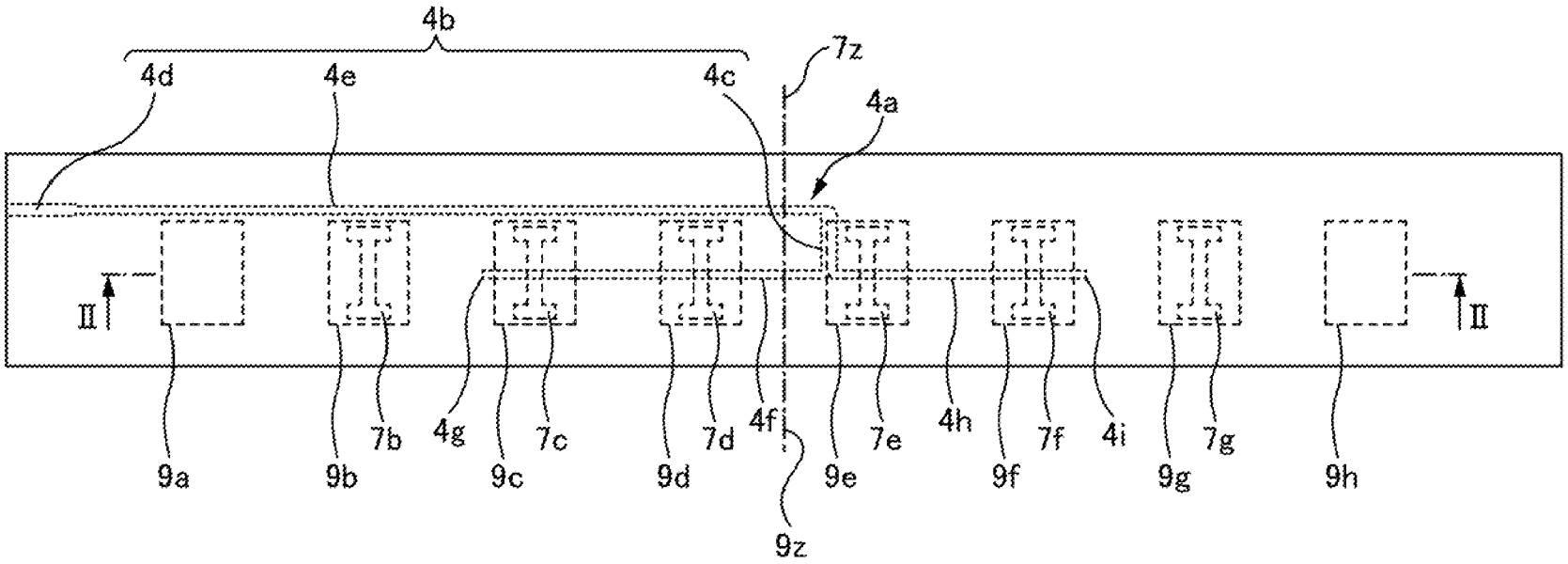
FIG. 8 is a plan view of an antenna according to another embodiment of the present disclosure.

(4) In an embodiment described above, the passive elements 9*a*, 9*b*, 9*g*, and 9*h* face the passive slots 7*a*, 7*b*, 7*g*, and 7*h*, respectively. In contrast, as illustrated in FIG. 8, the passive slots 7*a* and 7*h* may not be formed. In other words, the passive slots 7*a* and 7*h* may be filled with a conductor.

Figure 9:
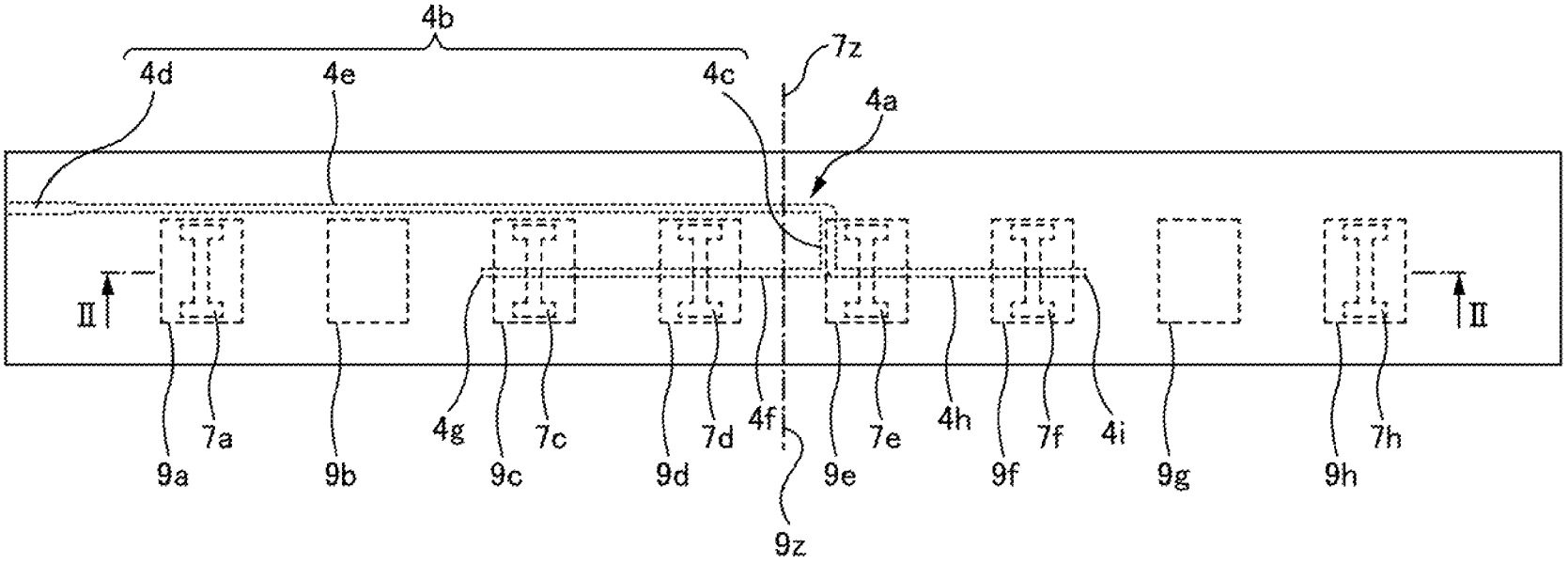
FIG. 9 is a plan view of an antenna according to another embodiment of the present disclosure.

As illustrated in FIG. 9, the passive slots 7*b* and 7*g* may not be formed. In other words, the passive slots 7*b* and 7*g* may be filled with a conductor.

Figure 10:
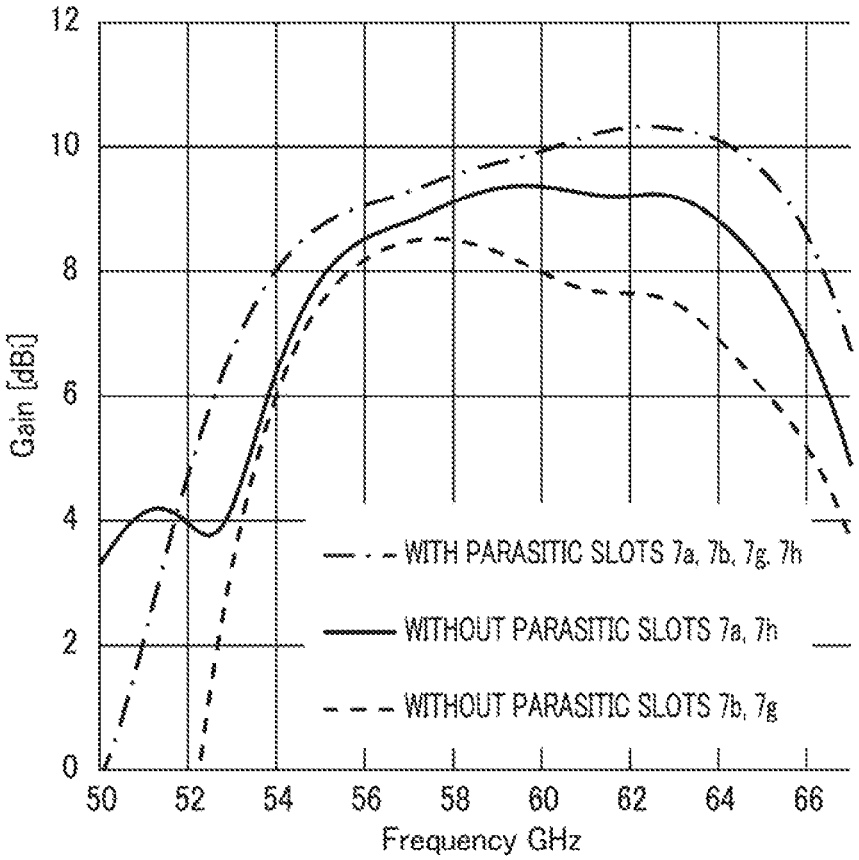
FIG. 10 is a graph illustrating a simulation result of gains of antennas illustrated in FIGS. 1, 8, and 9.

Herein, as illustrated in FIG. 8, when the passive slots 7*b* and 7*g* are formed without the passive slots 7*a* and 7*h* being formed, a gain of the antenna has been simulated. Furthermore, as illustrated in FIG. 9, when the passive slots 7*a* and 7*h* are formed without the passive slots 7*b* and 7*g* being formed, a gain of the antenna has been simulated. Results of the simulations are illustrated in FIG. 10. The vertical axis represents a gain and the horizontal axis represents a frequency in a graph in FIG. 10. A solid line indicates a result when the passive slots 7*b* and 7*g* are formed without the passive slots 7*a* and 7*h* formed, as illustrated in FIG. 8. A broken line indicates a result when the passive slots 7*a* and 7*h* are formed without the passive slots 7*b* and 7*g* being formed, as illustrated in FIG. 9. A dashed-dotted line indicates a result when the passive slots 7*a*, 7*b*, 7*g*, and 7*h* are formed. When these three cases are compared, a gain when the passive slots 7*a*, 7*b*, 7*g*, and 7*h* are formed, as illustrated in FIG. 1, is the highest, and a gain when the passive slots 7*a* and 7*h* are formed without the passive slots 7*b* and 7*g* being formed, as illustrated in FIG. 9, is the lowest.

(5) In an embodiment described above, the passive elements 9*a*, 9*b*, 9*g*, and 9*h* face the passive slots 7*a*, 7*b*, 7*g*, and 7*h*, respectively. In contrast, the passive slots 7*a*, 7*b*, 7*g*, and 7*h* may not be formed. In other words, the passive slots 7*a*, 7*b*, 7*g*, and 7*h* may be filled with a conductor.

(6) In an embodiment described above, the four active elements 9*c* to 9*f* are aligned between the first passive element 9*b* and the second passive element 9*g*, and the four active slots 7*c* to 7*f* are linearly aligned between the first passive slot 7*b* and the second passive slot 7*g*. In contrast, two, six, or more even-number of the active elements may be linearly aligned between the first passive element 9*b* and the second passive element 9*g*, and the same number of the active slots as the number of active elements may be aligned between the first passive slot 7*b* and the second passive slot 7*g*. In this case, the feed line 4*a* branches into two at a point between the active slots adjacent to each other in the center of the row of the slots in plan view, and the branch line portions 4*f* and 4*h* extend from the point of branch until the branch line portions cross the active slots at both ends of the row of the active slots in plan view.

(7) In an embodiment described above, the two first passive elements 9*b* and 9*a* are aligned with and extending from one end of the row of the active elements 9*c* to 9*f*, and the two second passive elements 9*g* and 9*h* are aligned with and extending from the other end of the row of the active elements 9*c* to 9*f*. In contrast, the single first passive element 9*b* may be aligned with and extending from the one end of the row of the active elements 9*c* to 9*f* without the first passive element 9*a* and the first passive slot 7*a* being provided. Similarly, the single second passive element 9*g* may be aligned with and extending from the other end of the row of the active elements 9*c* to 9*f* without the second passive element 9*h* and the second passive slot 7*h* being provided.

The three or more first passive elements may be aligned with and extending from the one end of the row of the active elements 9*c* to 9*f*, and the three or more second passive elements may be aligned with and extending from the other end of the row of the active elements 9*c* to 9*f*. In this case, the first passive slot and the second passive slot are set as in following (7a) or (7b).

(7a) The one or more first passive slots are formed so as to face at least one of the first passive elements, and the one or more second passive slots are formed so as to face at least one of the second passive elements.

(7b) The first passive slots are formed so as to face all of the first passive elements, respectively, and the second passive slots are formed so as to face all of the second passive elements, respectively.

Figure 11:
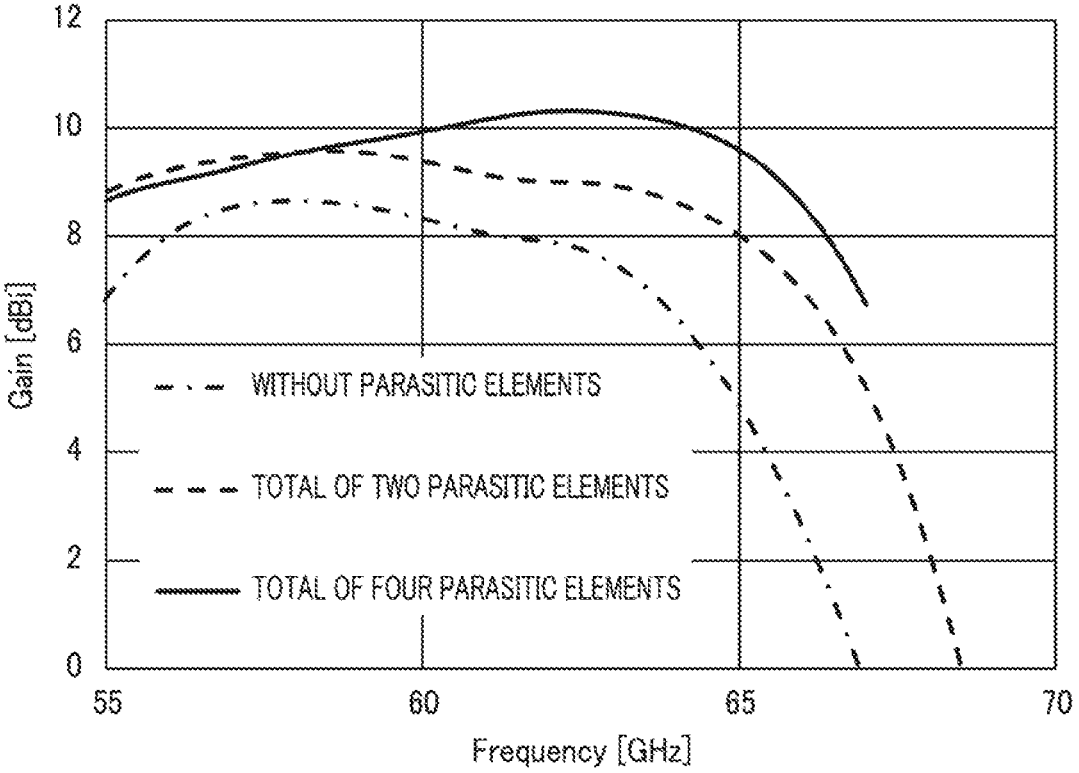
FIG. 11 is a graph illustrating a simulation result of a gain of an antenna with the number of passive elements continued to both ends of a row of active elements being changed.

Herein, effects of the number of the first passive elements and the number of the second passive elements on a gain have been verified by a simulation. A result of the simulation is illustrated in FIG. 11. The vertical axis represents a gain and the horizontal axis represents a frequency in a graph in FIG. 11. A solid line indicates a simulation result when the passive elements 9*a*, 9*b*, 9*g*, and 9*h* and the passive slots 7*a*, 7*b*, 7*g*, and 7*h* are provided. A broken line indicates a simulation result when the passive elements 9*b* and 9*g* and the passive slots 7*b* and 7*g* are provided, without the passive elements 9*a* and 9*h* and the passive slots 7*a* and 7*h* being provided. A dashed-dotted line indicates a simulation result when the passive elements 9*a*, 9*b*, 9*g*, and 9*h* and the passive slots 7*a*, 7*b*, 7*g*, and 7*h* are not provided.

As apparent from FIG. 11, a gain of the antenna is the lowest when the passive elements 9*a*, 9*b*, 9*g*, and 9*h* and the passive slots 7*a*, 7*b*, 7*g*, and 7*h* are not provided. In contrast, a gain of the antenna 1 is higher when the two passive elements 9*b* and 9*g* and the two passive slots 7*b* and 7*g* are provided. Furthermore, a gain of the antenna 1 is the highest when the four passive elements 9*a*, 9*b*, 9*g*, and 9*h* and the four passive slots 7*a*, 7*b*, 7*g*, and 7*h* are provided.

(8) In an embodiment described above, the elements 9*a* to 9*h* are aligned at regular intervals. In contrast, when the intervals between the active elements 9*c* to 9*f* are set to P1 [mm], the interval between the passive element 9*b* and the active element 9*c* and the interval between the passive element 9*g* and the active element 9*f* are set to P2 [mm], and the interval between the passive element 9*a* and the passive element 9*b* and the interval between the passive element 9*g* and the passive element 9*h* is set to P3 [mm], P1, P2, and P3 may satisfy any relationship of following (a) to (d).

(a) P1=P2, P2≠P3, P3≠P1

(b) P1≠P2, P2≠P3, P3=P1

(c) P1≠P2, P2=P3, P3≠P1

(d) P1≠P2, P2≠P3, P3≠P1

Even in any case of (a) to (d) described above, the active elements 9*c* to 9*f* are aligned at regular intervals, the interval between the passive element 9*b* and the active element 9*c* is equal to the interval between the passive element 9*g* and the active element 9*f*, and the interval between the passive element 9*a* and the passive element 9*b* is equal to the interval between the passive element 9*g* and the passive element 9*h*.

Figure 12:
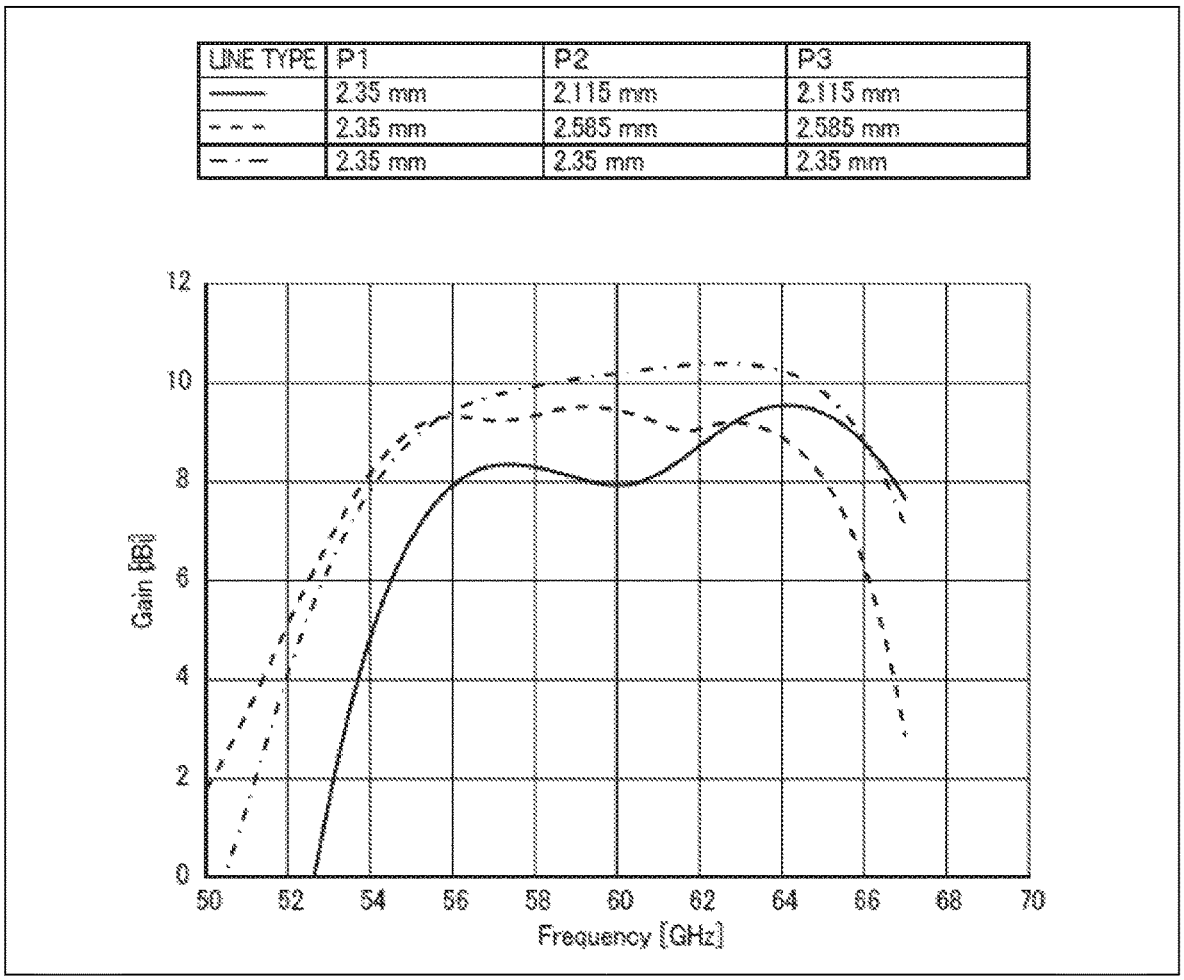
FIG. 12 is a graph illustrating a simulation result of a gain of an antenna.
Figure 13:
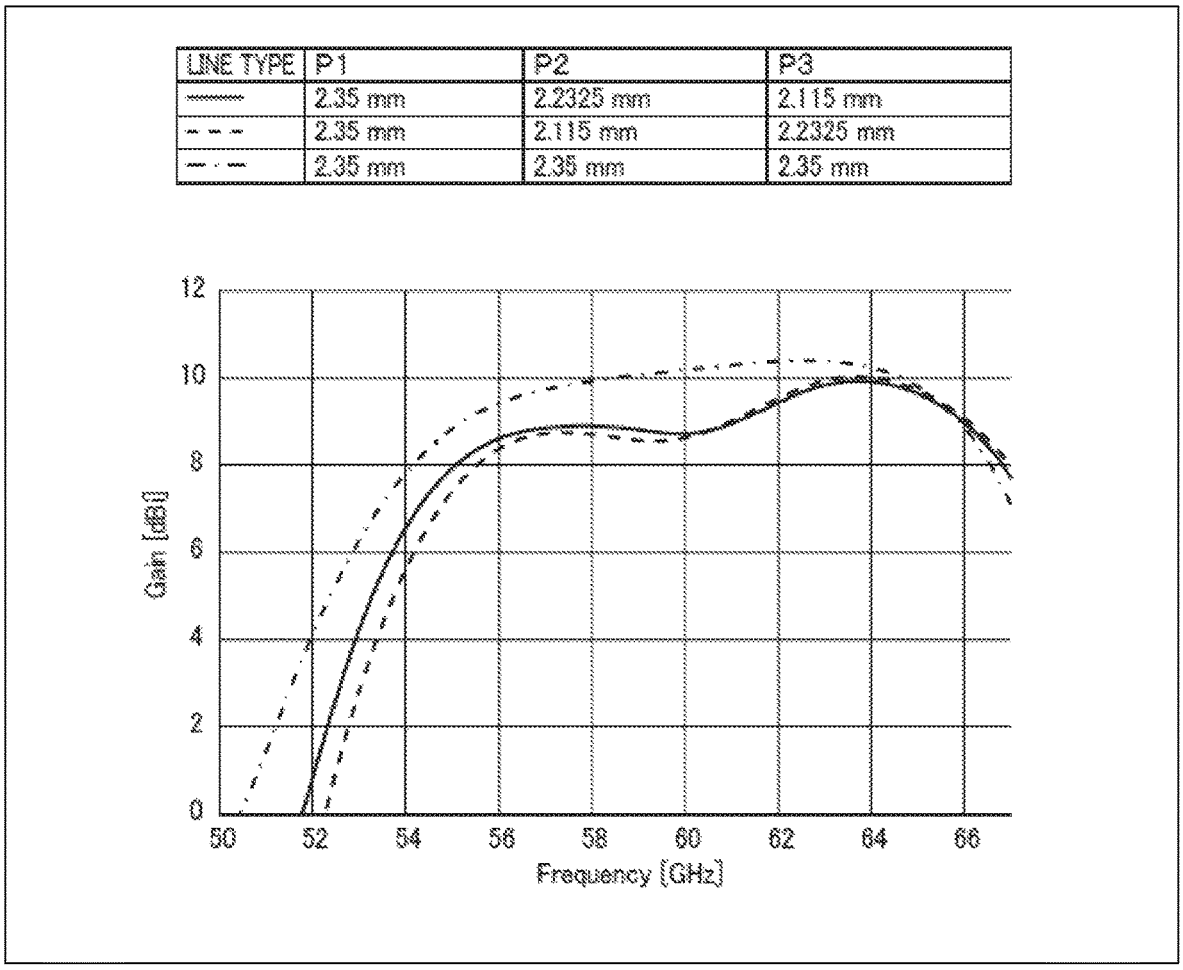
FIG. 13 is a graph illustrating a simulation result of a gain of an antenna.
Figure 14:
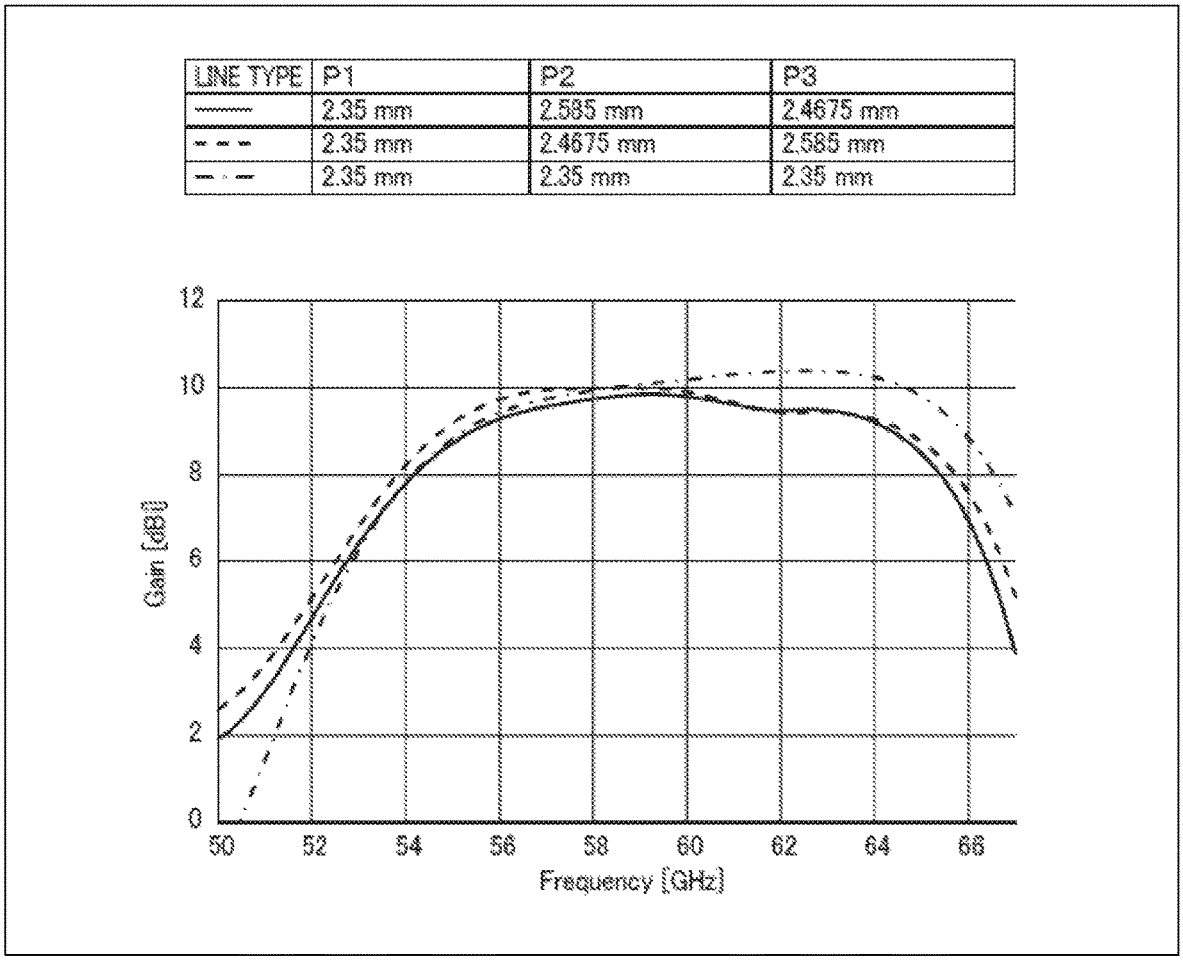
FIG. 14 is a graph illustrating a simulation result of a gain of an antenna.

Herein, a gain has been simulated when the intervals between the elements 9*a* to 9*h* are set to such values as illustrated in tables. Results of the simulations are illustrated in FIGS. 12 to 14. The vertical axis represents a gain and the horizontal axis represents a frequency in each graph in FIGS. 12 to 14.

As apparent from FIGS. 12 to 14, gains (solid line and broken line in FIGS. 12 to 14) when the interval between the passive element 9*b* and the active element 9*c* and the interval between the passive element 9*g* and the active element 9*f*, and the interval between the passive element 9*a* and the passive element 9*b* and the interval between the passive element 9*g* and the passive element 9*h* are different from the intervals between the active elements 9*c* to 9*f* are not much different from a gain (dashed-dotted line in FIGS. 12 to 14) when the elements 9*a* to 9*h* are aligned at regular intervals.

Figure 15:
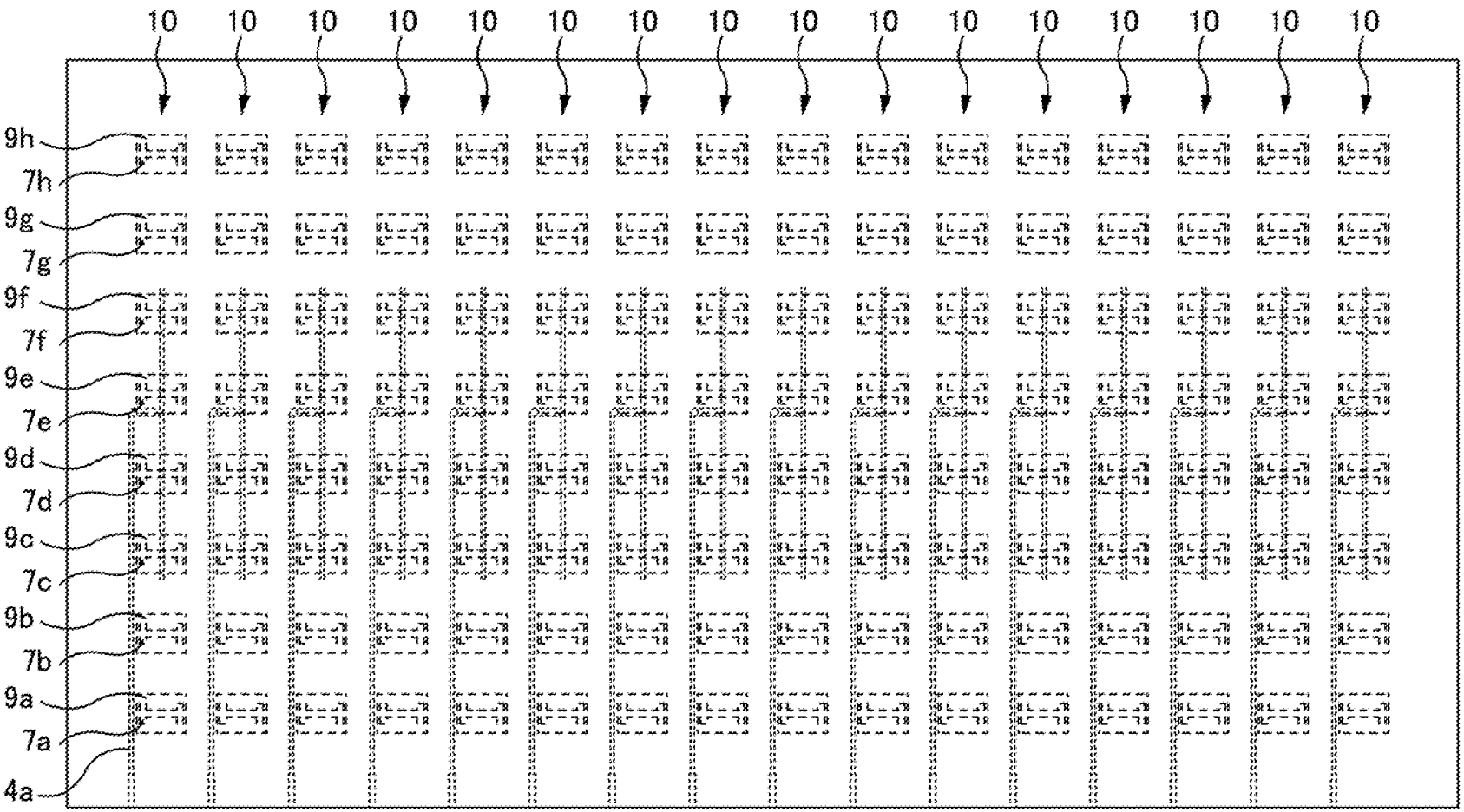
FIG. 15 is a plan view of an antenna according to another embodiment of the present disclosure.
Figure 16:
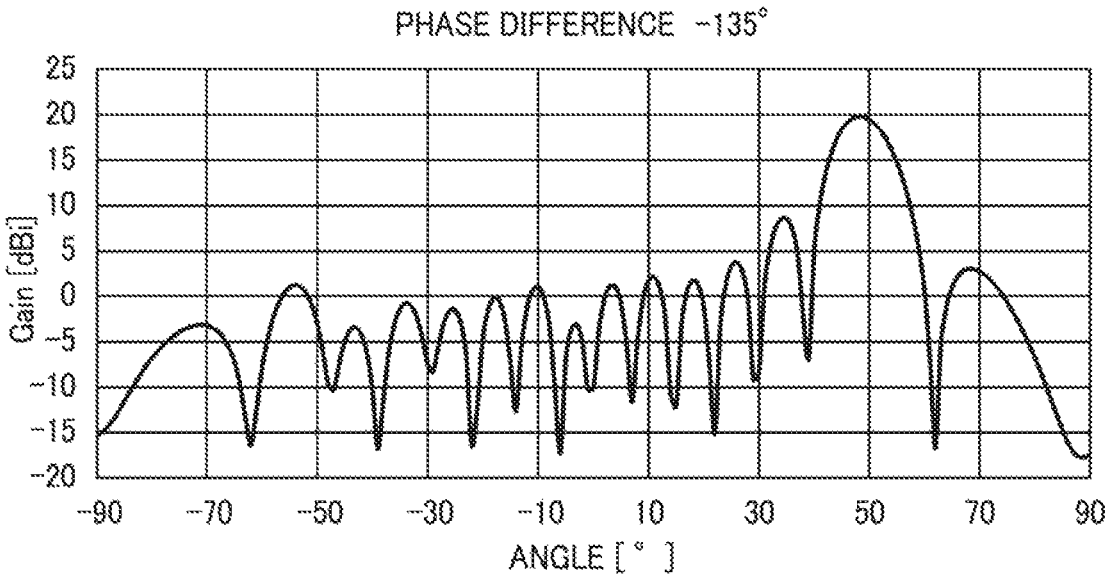
FIG. 16 is a graph illustrating a relationship between an inclination angle with respect to a normal line and a gain in a direction defined by the inclination angle when a phase difference between signal waves of feed lines adjacent to each other is −135°.
Figure 17:
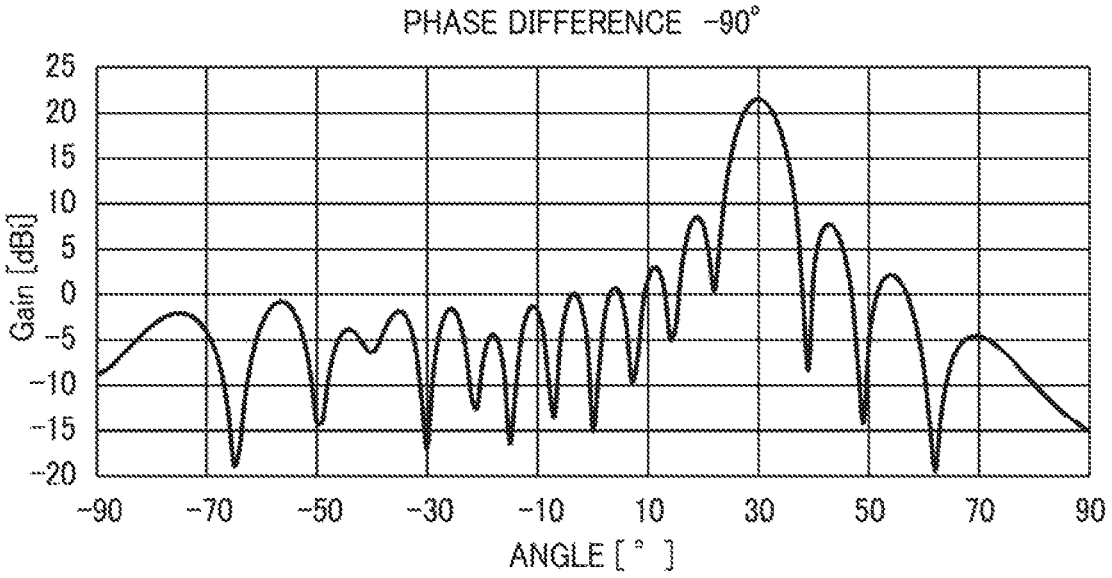
FIG. 17 is a graph illustrating a relationship between an inclination angle with respect to a normal line and a gain in a direction defined by the inclination angle when a phase difference between signal waves of feed lines adjacent to each other is −90°.

(9) In an embodiment described above, there is one group of the elements 9*a* to 9*h*, the slots 7*a* to 7*h*, and the feed line 4*a*. In contrast, as illustrated in FIG. 15, there may be a plurality of groups 10 each including the elements 9*a* to 9*h*, the slots 7*a* to 7*h*, and the feed line 4*a*. In this case, the plurality of groups 10 including the elements 9*a* to 9*h*, the slots 7*a* to 7*h*, and the feed line 4*a* are aligned in the direction orthogonal to the row direction of the elements 9*a* to 9*h*. The position in the row direction of the passive elements 9*a* in the groups 10 are aligned. The same applies to the elements 9*b* to 9*h* in the groups 10. The elements 9*a* to 9*h* in all of the groups 10 may be arranged in the single recess 8*b*. The elements 9*a* to 9*h* in each of the groups may be arranged in each recess 8*b*. The elements 9*a* to 9*h* may be individually arranged in the recesses, respectively. The directivity of an electromagnetic wave can be controlled by controlling the phase of a signal wave of each feed line 4*a*. This is verified by a simulation.

Figure 18:
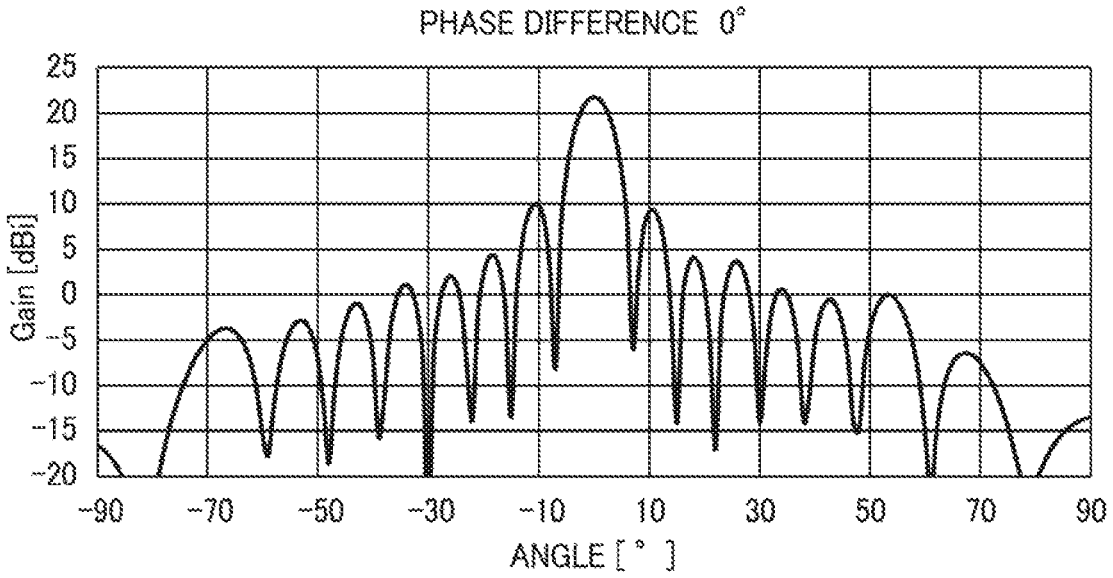
FIG. 18 is a graph illustrating a relationship between an inclination angle with respect to a normal line and a gain in a direction defined by the inclination angle when a phase difference between signal waves of feed lines adjacent to each other is 0°.
Figure 19:
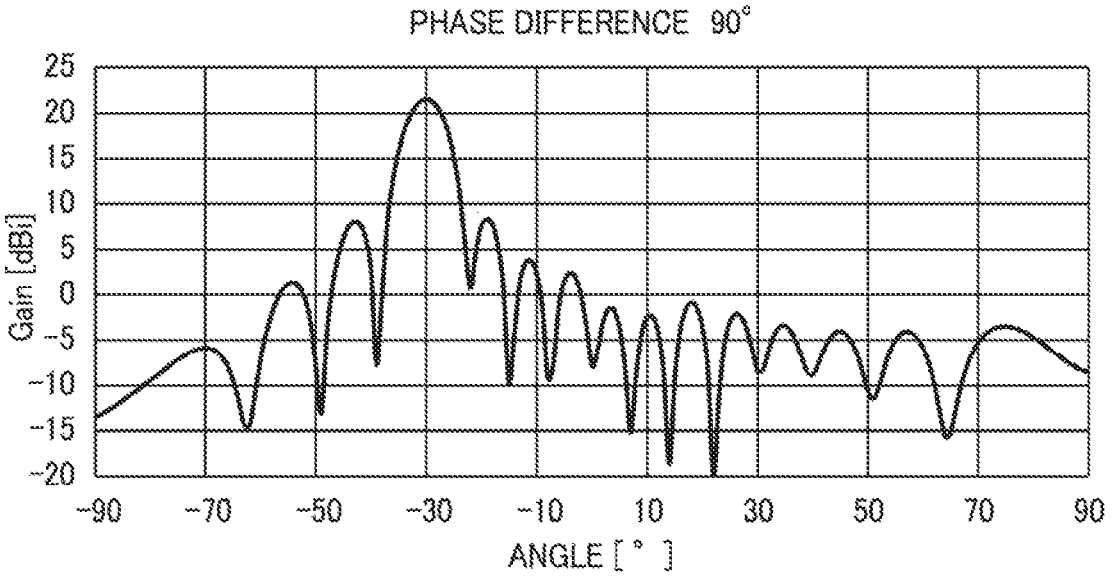
FIG. 19 is a graph illustrating a relationship between an inclination angle with respect to a normal line and a gain in a direction defined by the inclination angle when a phase difference between signal waves of feed lines adjacent to each other is 90°.
Figure 20:
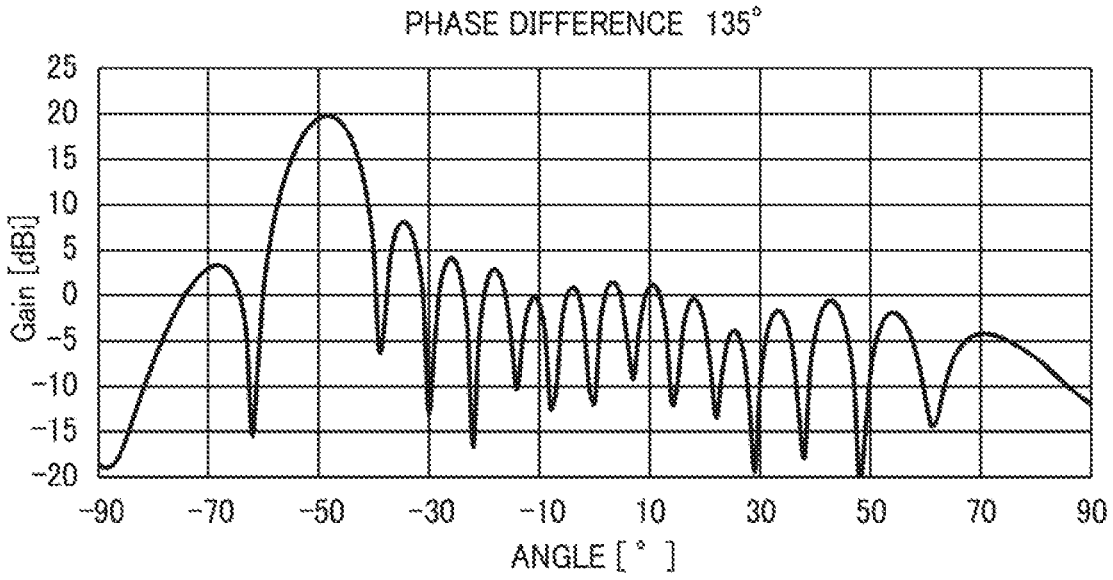
FIG. 20 is a graph illustrating a relationship between an inclination angle with respect to a normal line and a gain in a direction defined by the inclination angle when a phase difference between signal waves of feed lines adjacent to each other is 135°.

FIGS. 16 to 20 illustrate results when a phase difference between a signal wave of the other end portion 4*d* of each feed line 4*a* and a signal wave of the other end portion 4*d* of the feed line 4*a* adjacent thereto on the right in FIG. 15 is −135°, −90°, 0°, 90°, and 135°. The vertical axis represents a gain at 60 GHz and the horizontal axis represents an inclination angle with respect to the normal line in each graph in FIGS. 16 to 20. The inclination angle is an angle inclined to the direction orthogonal to the row direction of the elements 9*a* to 9*h* from the normal line. As illustrated in FIG. 18, when the phase difference is zero, directivity to the normal direction is high. As illustrated in FIGS. 16 to 20, as the absolute value of the phase difference increases, the direction in which sensitivity is high is inclined more with respect to the normal line. The maximum gain does not greatly change regardless of the phase difference.

REFERENCE SIGNS LIST

1 antenna
4*a* feed line
6 dielectric layer
7 conductive ground layer
7*a*, 7*b* first passive slot
7*c*, 7*d*, 7*e*, 7*f* active slot
7*g*, 7*h* second passive slot
8 dielectric substrate
8*b* recess
8*d* bottom of recess
9*a*, 9*b* first passive element

9*c*, 9*d*, 9*e*, 9*f* active element
9*g*, 9*h* second passive element

The invention claimed is:

1. An antenna comprising:

a dielectric layer;

a conductive ground layer bonded to the dielectric layer, the conductive ground layer including even-numbered active slots aligned at regular intervals;

a plurality of active elements formed so as to face the active slots, respectively, the active elements aligned at regular intervals;

one or more first passive elements aligned with and extending from one end of a row of the active elements;

one or more second passive elements aligned with and extending from another end of the row of the active elements; and a feed line formed on a side opposite to the conductive ground layer with respect to the dielectric layer, the feed line configured to be electromagnetically coupled to the active elements via the active slots, the one or more second passive elements being arranged in line symmetry with the one or more first passive elements with respect to a line that passes through the center of the row of the active elements and is perpendicular to the row.

2. The antenna according to claim 1, wherein, the conductive ground layer includes one or more first passive slots formed so as to face at least one of the first passive elements, and one or more second passive slots formed so as to face at least one of the second passive elements.

3. The antenna according to claim 2, wherein, the conductive ground layer includes the one or more first passive slots formed so as to face all of the one or more first passive elements, and the one or more second passive slots formed so as to face all of the one or more second passive elements.

4. The antenna according to claim 1, wherein the feed line branches at a point between the active slots adjacent to each other that are positioned in the center of the row of the active slots in plan view, the feed line having branch portions that extend from the point of branch until the branch portions cross the active slots at both ends of the row of the active slots in plan view, respectively.

5. The antenna according to claim 4, wherein a difference between an electrical length of a portion from the point of branch to one of the active slots adjacent to each other in plan view in the feed line and an electrical length of a portion from the point of branch to another of the active slots adjacent to each other in plan view in the feed line is equal to a quarter of an effective wavelength in the center of a band to be used.

6. The antenna according to claim 1, further comprising a dielectric substrate including a recess, wherein the conductive ground layer is bonded to the dielectric substrate so as to cover the recess, the active slots are arranged on an inner side with respect to the recess, and the active elements, the one or more first passive elements, and the one or more second passive elements are formed on a bottom of the recess.

* * * * *